United States Patent [19]

Murdoch

[11] 4,087,015

[45] May 2, 1978

[54] CLOSURE MEANS FOR A CONTAINER

[75] Inventor: Colin Albert Murdoch, 14a Hassall Street, Timaru, New Zealand

[73] Assignee: Colin Albert Murdoch, Timaru, New Zealand

[21] Appl. No.: 786,756

[22] Filed: Apr. 12, 1977

[30] Foreign Application Priority Data

Apr. 12, 1976 New Zealand ..... 178682

[51] Int. Cl.[2] ..... B65D 55/02; B65D 85/56; A61J 1/00

[52] U.S. Cl. ..... 215/201; 206/1.5

[58] Field of Search ..... 215/201, 203, 365; 206/1.5

[56] References Cited

U.S. PATENT DOCUMENTS 3,698,543 10/1972 Trotta ..... 215/201 X 3,830,392 8/1974 Kessher et al. ..... 215/201 X

*Primary Examiner*—George T. Hall

*Attorney, Agent, or Firm*—Fisher, Christen & Sabol

[57] ABSTRACT

A closure for a container is disclosed which prevents accidental openings or opening by children. The closure is attached to a hollow container having a wall across the dispensing end with an opening therethrough to allow removal of the contents. The wall also has a central opening and a slot extending away from the dispensing opening. The closure has a plug extending through the central opening, the plug having an enlarged end to prevent removal of the closure from the container. To open the container, the closure is manually depressed and rotated to align the plug with the slot, and the closure is manually slid laterally across the container to uncover the dispensing opening.

7 Claims, 5 Drawing Figures

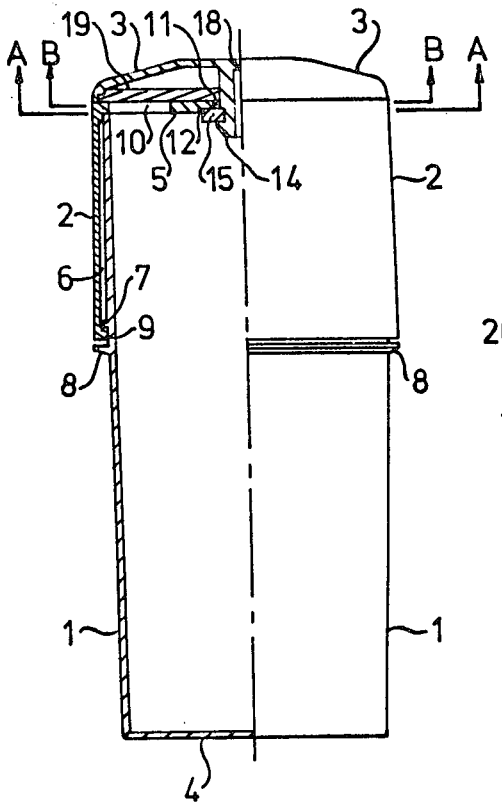
FIG 1
FIG 2
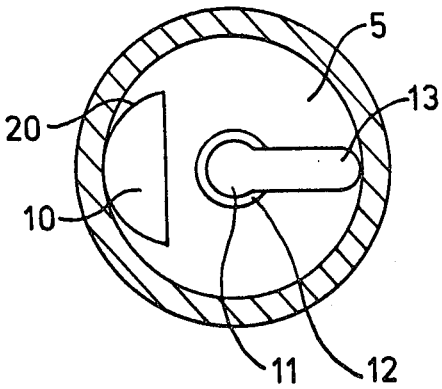
FIG 3
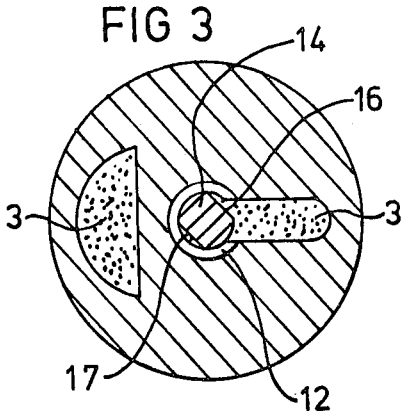
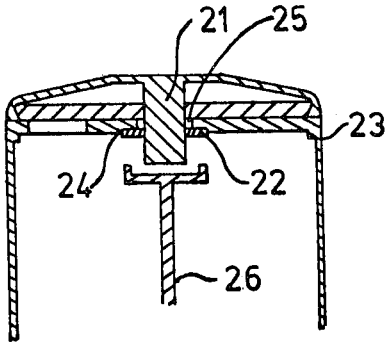
FIG 4
FIG 5
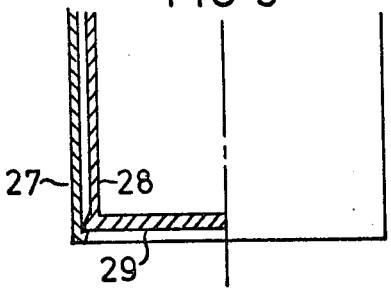

CLOSURE MEANS FOR A CONTAINER

FIELD OF THE INVENTION

This invention relates to containers and closure means therefor, and has particular application to containers of toxic substances, for example pharmaceutical, agricultural or industrial preparations of a dangerous or restricted nature.

BRIEF DESCRIPTION OF THE PRIOR ART

Known containers of such substances have been made of glass, metal, earthenware, wood and, more recently, plastics materials, and their closure means have been, typically, screw or press-fitting lids and bungs. Recent attention to safety, particularly that of children in relation to pharmaceutical containers, has resulted in the development of various "childproof" closures, but these are relatively ineffective against older, stronger, more intelligent or more perseverant children, and recent attention has been paid to the use of foil strips as containers of tablets. These strips are primarily intended to preserve sterility, and as containers they are expensive, inconvenient and bulky, and are not particularly childproof. The object of the present invention is to provide a more childproof closure means for a hollow container such as a bottle or a jar.

SUMMARY OF THE INVENTION

According to the present invention, a hollow container has:

(a) a cap having a plug extending from a face thereof; and (b) in a wall of the container, a slot retaining the plug for sliding in the slot across the said wall, and an aperture positioned so as to be covered by the cap at a first point of the travel of the plug in the slot and to be uncovered by the cap at a second point of the travel of the plug in the slot; wherein (c) the plug and the slot are shaped to co-operate in retaining the plug at the said first point of travel in the slot until movement of the plug relative to the slot releases the plug for sliding in the slot.

In a first preferred form of the invention, the plug has a widened head inside the container, the head seating at the said first point of travel in a widened portion of the slot which faces inwardly of the container. In this form of the invention, the cap is freed for movement by depressing the plug inwardly of the container and, preferably, the plug is resiliently depressible. The cap may, for example, be dome-shaped for resilient depression of the plug by pressing or squeezing the cap.

In a second preferred form of the invention, the portion or portions of the slot which adjoin that part of the slot which contains the said first point of travel of the slot are made narrower than the said part of the slot, and the plug is formed with a shaft portion extending through the slot, the shaft portion being of different thickness at different places around its circumference, at least one such thickness being greater than and at least one other such thickness being less than or equal to the width of the slot in the said portion or portions thereof. In this form of the invention, the cap is freed for movement by rotating the plug until it presents to the slot a thickness which will allow it to move from the said first point of its travel. Conveniently, the plug may be rigidly affixed to the body of the cap, and rotatable by rotating the cap. Preferably, the shaft portion is about most of its circumference of a thickness greater than the width of the slot in its said portion or portions, thus reducing the chances of accidental opening of the container — for example the shaft portion may be substantially cylindrical except for two opposite flat faces spaced apart by the width of the slot in its said portion or portions.

The first and second preferred forms of the invention may be combined in a single embodiment in which the plug must be both depressed and rotated into alignment with the slot to open the container.

The present invention further provides a label holder for a container, comprising a transparent sleeve which is fittable about the outside of the container with a space between the sleeve and the body of the container. The space may be an annular space about the body of the container. The sleeve may further be provided with a slot therethrough for the insertion of a label into the space. The sleeve may be in the form of a tube with a closed end which can form a wall of the container.

BRIEF DESCRIPTION OF THE DRAWINGS

FIG. 1: is a partially sectioned elevation of a container according to the invention;

FIG. 2: is a section taken on line A—A' of FIG. 1, not showing a cap shown in FIG. 1;

FIG. 3: is a section taken on line B—B' of FIG. 1;

FIG. 4: is a sectioned elevation of a sleeve and cap of a container according to the invention, showing a method of forming a plug of a cap of the container;

FIG. 5: is a partially sectioned elevation of a bottom portion of a container according to the invention showing a method of engaging a body portion and sleeve of the container.

DETAILED DESCRIPTION OF THE PREFERRED EMBODIMENTS

The embodiments of the invention shown in the drawings are hereunder described by way of example only to better characterise the invention and show how it is to be carried into effect, and the invention is not limited to the embodiments thus shown and described.

FIGS. 1, 2 and 3 show in true size a childproof pharmaceutical container consisting of a body portion 1, a sleeve 2 engaged therewith, and a cap 3 engaged with the sleeve. The body portion is in the form of a cylinder with one closed end 4 forming the bottom of the container. The sleeve also is substantially in the form of cylinder with one closed end 5 forming the top of the container. The internal diameter of the sleeve is such that it fits over the outside and the open end of the body portion with an annular space 6 between the sleeve and the body portion for the insertion of a label therein. The sleeve is transparent to allow such label to be seen. The sleeve and the body portion are engaged firmly together by means of resilient engagement of co-operating ridges 7, 8 on the body portion and a lip 9 of the sleeve.

The top 5 of the container is provided with an aperture 10 for the removal of the contents of the container, and also with a central hole 11 therethrough. The hole is stepped, having a greater width 12 facing inwardly of the container, and has an extension 13 of slightly less width than the least diameter of the central hole extending away from the aperture 10.

The cap is in the form of a flattened dome, having a plug 14 extending from the centre of the dome through the central hole 11 of the top of the container. The plug is provided with a widened portion inside the container which seats in the wider portion 12 of the hole 11 but cannot pass completely through the hole. In the embodiment shown in FIG. 1, the widened portion of the plug is a ring 15, but it may comprise simply a widened head of the plug.

The plug is shown in radial cross section in FIG. 3 and is substantially cylindrical of the same diameter as the smallest diameter of the central hole 11, save for two opposite parallel flat faces 16, 17 having a thickness of the plug between them equal to the width of the extension 13 of the central hole 11. Thus the plug can slide along the extension when, and only when, the flat faces 16, 17 are aligned with the extension, and the plug is depressed inwardly of the container to free the ring 15 from its engagement with the widened portion 12 of the central hole. The domed cap is made of a resilient material to permit such depression and, if required, the resistance to such depression may be made very slight (for example by adjusting the thickness of the domed portion 18) to permit opening of the container by people with weak hands.

To assist in free movement over the top of the container, the cap is provided with a plate 19 to prevent the cap from tipping over the edge 20 of the aperture 10 nearest the outer wall of the container is curved with a smaller radius of curvature than that of the edge of the cap.

The container shown in FIGS. 1, 2 and 3 is made entirely of plastic materials and the parts are all press-fitted together. The body portion 1 and the domed cap are made of a material having some resilience, for example polyvinyl chloride, and are preferably opaque to prevent a child from seeing the central hole, its extension 13 and the plug. The sleeve is made of a comparatively rigid material, for example a polycarbonate, and the plate 19 is also comparatively rigid and may advantgeously be made of a self-lubricating material such as a polyamide. The cap is assembled on the sleeve by inserting the plug through the central hole 11 and then pressing the ring 15 onto the plug. After the container has been filled, the sleeve can be pressed into permanent engagement with the body portion after placing a label in the annular space 6. If it is preferred, the sleeve may be provided with a slot allowing the label to be inserted after the sleeve has been engaged with the body portion. To assist the user to open the container, the cap and the sleeve may have markings indicating the correct alignment of the cap to allow the plug to move along the extension 13 of the central hole 11.

FIG. 4 shows an alternative method of assembling the cap on the sleeve and forming the widened portion of the plug. In a container generally similar to that shown in FIGS. 1, 2 and 3, the plug 21 is a solid shaft of a thermoplastic material and, when the cap is placed on the sleeve, it extends into the container. A washer 22 is placed around the shaft of the plug to prevent fusing with the sleeve 23 and seats in a wider portion 24 of a central hole 25 through the end portion of the sleeve. A widened head is formed on the plug by ultasonic fusion and pressure by a mould 26.

In further alternative embodiments of the invention, the plug may include or consist of a rivet or screw or any other member having a shaft and a widened head. It may be desirable in some applications of the invention to have a cap that opens only by turning or by being depressed rather than by both, and to this end the widened portion of the plug may not seat in a stepped portion of the central hole 11, 25 (thus removing the need to depress the cap), or the extension 13 of the central hole 11, 25 may be as wide as the narrowest portion of the central hole, and the plug cylindrical (thus removing the need to align the plug with the extension 13).

Where the container is small, or a large space for a label is desired, it may be advantageous to have the sleeve extend over the whole depth of the body portion. FIG. 5 shows one method of resiliently engaging a sleeve 27 over the end of a body portion 28 which is covered by the sleeve except for its bottom end face 29.

If sealing of the container is required, for example where the sterility of a pharmaceutical preparation must be preserved, the container may further include an adhesive seal, for example a foil disc, affixed to the end face of the body of the container, between the body of the container and the cap.

I claim:

1. Closure means for a container comprising:

(a) a cap having plug means extending therefrom, (b) in a wall of the container, slot means retaining the plug for sliding therein across the wall of the container, (c) in the said wall of the container, an opening into the container positioned so as to be covered by the cap when the plug means is at a first point in its travel in the slot means and to be uncovered by the cap when the plug means is at a second point in its travel in the slot means; wherein the plug means and the slot means are shaped to engage together at the said first point in the travel of the plug until released by a predetermined movement of the plug means relative to the slot means.

2. Closure means as claimed in claim 1, characterized in that the plug means includes head means inside the container, such head means seating at the said first point in a widened portion of the slot means facing inwardly of the container.

3. Closure means as claimed in claim 2, further characterized in that the plug means is affixed to or integral with a portion of the cap which is resiliently depressible inwardly of the container.

4. Closure means as claimed in claim 3, further characterized in that the said portion of the cap is made of a resiliently deformable plastics material.

5. Closure means as claimed in claim 1, characterized in that a first portion of the slot means which surrounds the said first point is wider than the portion or portions of the slot means adjacent thereto, and the plug means includes shaft means extending through the slot means, the shaft means being of at least two different thicknesses at different parts of its circumference such that at least one such thickness is greater than and at least one other such thickness is equal to or less than the width of the said portion or portions of the slot adjacent to the said first portion.

6. Closure means as claimed in claim 5, further characterized in that the said shaft means is substantially cylindrical except for two diametrically opposite faces spaced apart by the said other such thickness.

7. Closure means as claimed in claim 5, further characterized in that the said shaft means is non-rotatably affixed to or integral with the cap and the cap is rotatable relative to the container.

* * * * *